US011815253B2

(12) United States Patent
Miura et al.

(10) Patent No.: US 11,815,253 B2
(45) Date of Patent: Nov. 14, 2023

(54) LIGHT SOURCE DEVICE, COOLING METHOD, AND MANUFACTURING METHOD FOR PRODUCT

(71) Applicant: CANON KABUSHIKI KAISHA, Tokyo (JP)

(72) Inventors: Takao Miura, Tochigi (JP); Kazuyuki Kasumi, Tochigi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/542,195

(22) Filed: Dec. 3, 2021

(65) Prior Publication Data

US 2022/0178533 A1 Jun. 9, 2022

(30) Foreign Application Priority Data

Dec. 8, 2020 (JP) ..... 2020-203466

(51) Int. Cl.

| | |
|---|---|
| ***F21V 29/71*** | (2015.01) |
| ***F21V 29/52*** | (2015.01) |
| ***F21V 23/00*** | (2015.01) |
| *F21Y 115/10* | (2016.01) |

(52) U.S. Cl.
CPC ..... *F21V 29/71* (2015.01); *F21V 23/004* (2013.01); *F21V 29/52* (2015.01); *F21Y 2115/10* (2016.08)

(58) Field of Classification Search
CPC ..... F21V 29/83; F21V 29/52; F21V 29/71; F21V 23/004; F21Y 2115/10
See application file for complete search history.

(56) References Cited

FOREIGN PATENT DOCUMENTS

| | | | | |
|---|---|---|---|---|
| CN | 114624962 A | * | 6/2022 | ..... F21V 23/004 |
| EP | 3301999 A1 | * | 4/2018 | ..... B33Y 30/00 |
| JP | 2011165509 A | | 8/2011 | |

* cited by examiner

*Primary Examiner* — Anabel Ton
(74) *Attorney, Agent, or Firm* — CANON U.S.A., INC. IP Divison

(57) ABSTRACT

An LED light source module includes a circuit board, solid-state light emitting elements arranged on the circuit board, a heatsink disposed in contact with the circuit board and having a channel formed inside, through which refrigerant flows, and a switching unit configured to switch a flow direction of refrigerant through the channel to an opposite direction.

10 Claims, 13 Drawing Sheets

LIGHT SOURCE DEVICE, COOLING METHOD, AND MANUFACTURING METHOD FOR PRODUCT

BACKGROUND OF THE DISCLOSURE

Field of the Disclosure

The aspect of the embodiments relates to a light source device, a cooling method, and a manufacturing method for a product.

Description of the Related Art

In a photolithography process in manufacturing a device, such as a semiconductor device and a flat panel display (FPD), an exposure apparatus that transfers the pattern of a mask to a substrate is used. For example, a mercury lamp is used as a light source of the exposure apparatus. In recent years, a mercury lamp is expected to be replaced with a light emitting element (LED) that is more energy-efficient than the mercury lamp. An LED takes a shorter time from when a current is passed through a circuit to when the light output is stable and does not need to constantly emit light unlike a mercury lamp, so the LED has a longer life.

Since an LED has a low luminance per one chip, a light source in which a plurality of LED chips is arranged on a circuit board is to be used to obtain a target illuminance. The number of LED chips needed to obtain an illuminance equivalent to that of a mercury lamp is, for example, about several thousands. At the time of causing LED chips to emit light, the temperature of the LED chips increases, so the LED chips need to be cooled.

The life of an LED chip (the lighting time of an LED chip) depends on the temperature of the LED chip at the time when the LED chip emits light, and the life of the LED chip shortens as the temperature of the LED chip increases. Here, for example, in an exposure apparatus using a light source (LED light source module) in which a plurality of LED chips is arranged on a circuit board, when part of the LED chips reach the end of life and a target amount of light is not obtained, the LED chips together with the circuit board are to be replaced with new ones. In other words, when there are temperature variations among a plurality of LED chips, the replacement timing of an LED light source module may become early. Japanese Patent Laid-Open No. 2011-165509 describes that a plurality of LED chips arranged in a one-dimensional array can be uniformly cooled by providing two channels for the plurality of LED chips and flowing refrigerant through the channels in opposite directions.

When the channels configured as described in Japanese Patent Laid-Open No. 2011-165509 are formed, the width of each channel is narrow, with the result that the cooling power of refrigerant may decrease. When LED chips are arranged two dimensionally, many channels are to be formed to uniformly cool the plurality of LED chips. When the cooling power of refrigerant is intended to be improved, it is desirable to form channels as simple as possible such that the width of each of the channels is not narrow. When, for example, the number of channels is one, the flow rate of refrigerant per unit time is improved. However, in this case, cooling power for cooling LED chips decreases at a downstream side of the channel, a plurality of LED chips is not uniformly cooled. As a result, the replacement timing of an LED light source module becomes early as compared to when a plurality of LED chips is uniformly cooled.

SUMMARY OF THE DISCLOSURE

A device includes a circuit board, a plurality of light emitting elements (LEDs) disposed on the circuit board, and a heatsink configured to cool the plurality of LEDs, wherein a flow direction of refrigerant through the channel in the heatsink is switchable between a first direction and a second direction opposite to the first direction.

Further features of the disclosure will become apparent from the following description of exemplary embodiments with reference to the attached drawings.

DESCRIPTION OF THE EMBODIMENTS

Figure 1A:
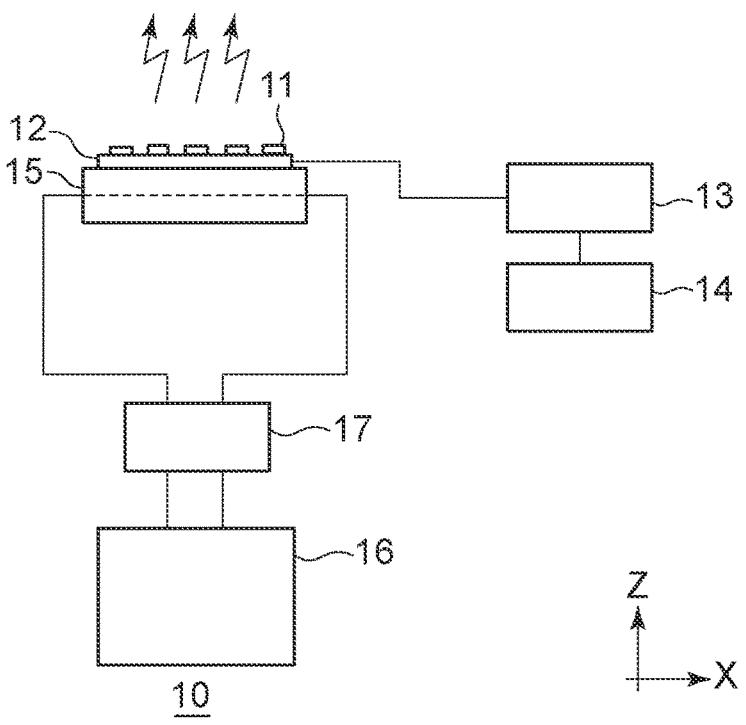
FIG. 1A to FIG. 1C are schematic diagrams showing the configuration of a light source device.

Hereinafter, embodiments of the disclosure will be described in detail with reference to the attached drawings. Like reference signs denote the identical components in the drawings, and the repeated description is omitted.

First Embodiment

A light source device 10 according to the present embodiment will be described with reference to FIG. 1A to FIG. 1C. FIG. 1A is a diagram showing the overall configuration of the light source device 10. The light source device 10 includes LED chips 11 (solid-state light emitting elements), a circuit board 12, a power supply 13, and a control section 14. A module in which the plurality of LED chips is arranged on the circuit board 12 is also referred to as LED light source module. The light source device 10 further includes a heatsink 15, a refrigerator 16 (also referred to as chiller), and a switching mechanism 17 (switching unit) to cool the LED chips 11. In the present embodiment, a plane in which the LED chips 11 are arranged is defined as XY-plane, and a direction vertical to the XY-plane is defined as Z-axis direction.

Figure 1B:
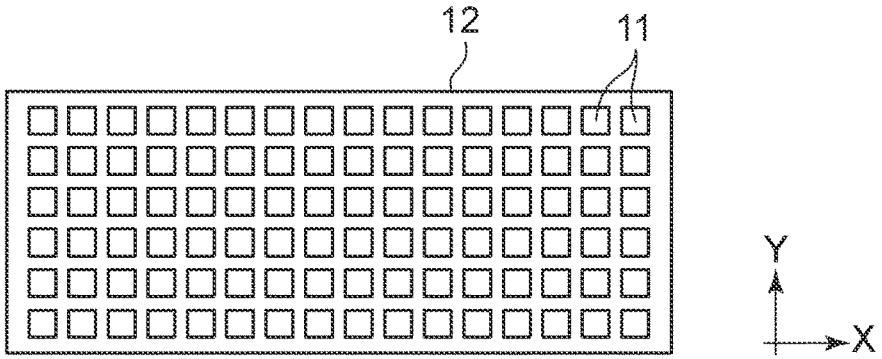

FIG. 1B is a diagram showing the configuration of a light-emitting surface of the light source device 10. Copper wires are implemented in the circuit board 12, and a circuit for causing the LED chips 11 to emit light is formed. The material used for the wires of the circuit may be a material other than copper. When a current flows through the circuit, light having a predetermined wavelength is output from the LED chips 11. In the present embodiment, an example in which the plurality of LED chips 11 is arranged in a two-dimensional array will be described; however, the configuration is not limited thereto. The LED chips 11 may be arranged in a one-dimensional array. The power supply 13 is connected to the circuit of the circuit board 12 and supplies electric power for causing the LED chips 11 to emit light. The power supply 13 is connected to the control section 14 and controls the illuminance and the like of the LED chips 11 in accordance with a command from a host control system (not shown).

The LED chips 11 generate heat as the LED chips 11 emit light, and the temperature of the LED chips 11 increases. The configuration of the light source device 10 for cooling heat generated as a result of emission of the LED chips 11 will be described. In the present embodiment, a heat exchange between refrigerant and the circuit board 12 is performed by flowing refrigerant through the light source device 10. With the heat exchange, the LED chips 11 are cooled. To increase the efficiency of a heat exchange, a material having a high thermal conductivity can be used for the circuit board 2. For example, copper or aluminum having a high thermal conductivity can be used as the material of the circuit board 2. For example, a liquid containing water having an excellent cooling power as a principal component or a liquid containing oil having an excellent electrical insulation property as a principal component can be used as refrigerant. In the present embodiment, an example in which the LED chips 11 are cooled by liquid will be described; however, the configuration is not limited thereto. For example, the LED chips 11 may be cooled by air by blowing low-temperature gas.

Figure 1C:
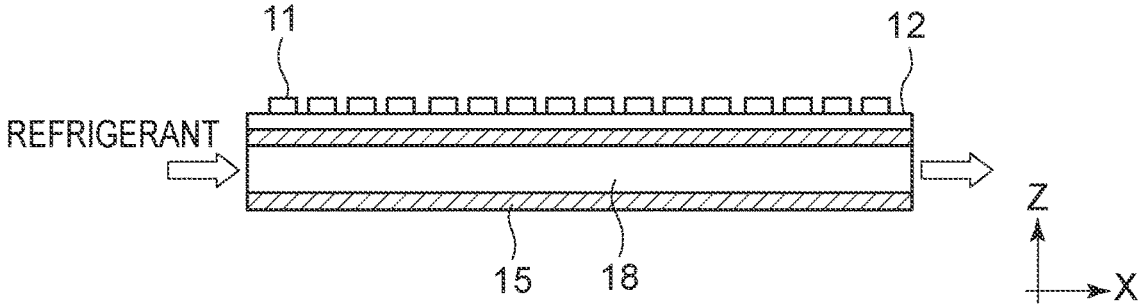

FIG. 1C is a diagram showing the cross-sectional view of the heatsink 15 of the light source device 10. The heatsink 15 absorbs heat released at the time when the LED chips 11 emit light. The heatsink 15 is held in contact with the back surface (the surface opposite from the surface on which the LED chips 11 are arranged) of the circuit board 12. A channel 18 for flowing refrigerant is linearly provided inside the heatsink 15. The channel 18 is connected to a refrigerator 16 via a pipe, and refrigerant discharged from the channel 18 is conveyed to the refrigerator 16 for cooling. The refrigerator 16 controls the temperature of refrigerant to a certain temperature (for example, 20° C.) by cooling the refrigerant and circulates the refrigerant to perform a heat exchange with the circuit board 12 again. For example, a liquid containing water having an excellent cooling power as a principal component or a liquid containing inactive oil having an excellent electrical insulation property as a principal component can be used as refrigerant to cool the LED chips 11.

In the present embodiment, the switching unit implemented by, for example, providing the switching mechanism 17 between the heatsink 15 and the refrigerator 16 is provided, and the switching unit is configured to be capable of switching the flow direction of refrigerant through the channel 18. A specific example of the switching unit will be described with reference to first to fourth examples (described later).

Life of LED Chip

Figure 2:
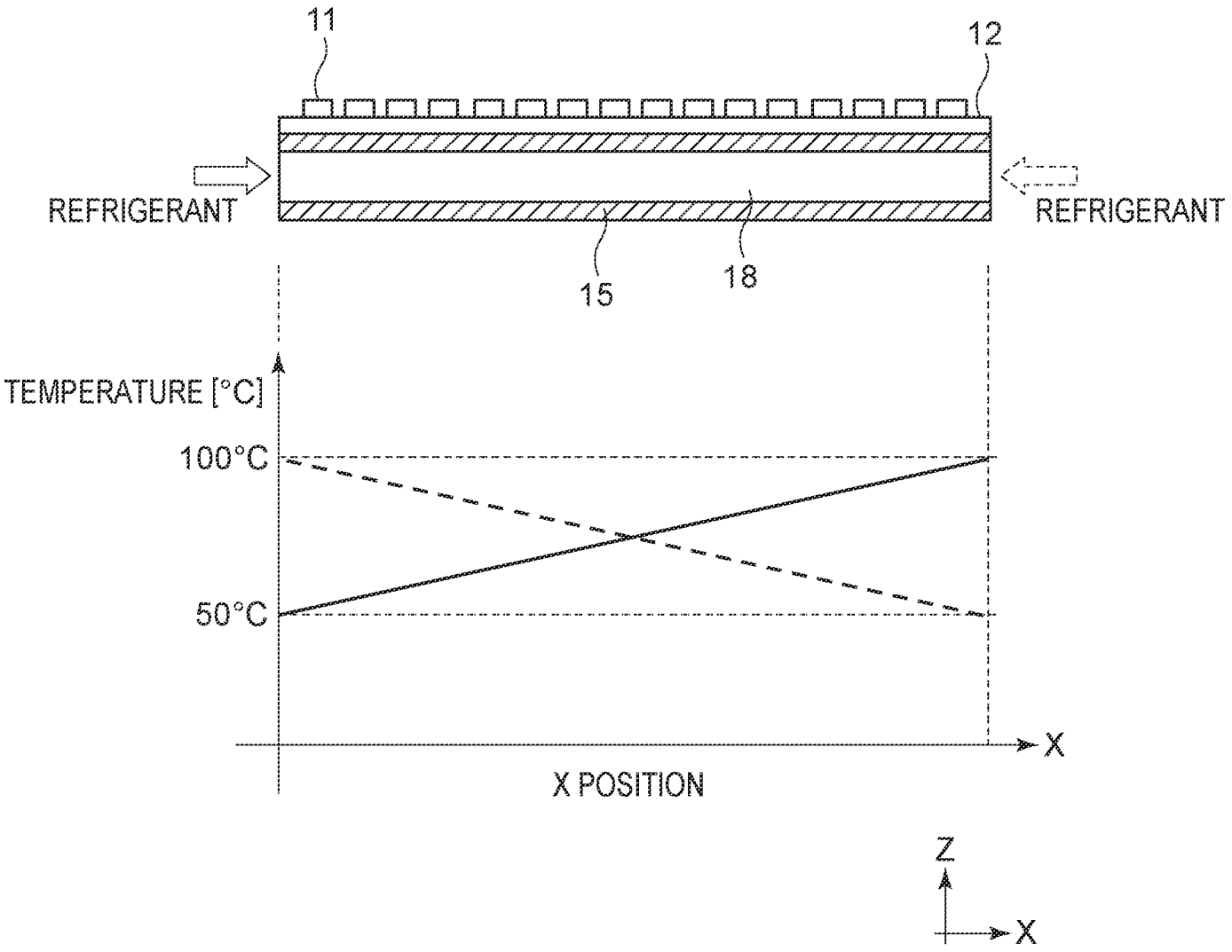
FIG. 2 is a view showing a temperature distribution among LED chips.

An influence due to variations in the temperatures of the plurality of LED chips 11 will be described with reference to FIG. 2. FIG. 2 is a view showing a temperature distribution among the plurality of LED chips 11 in the light source device 10. The temperature represented by the continuous line in the graph of FIG. 2 is a temperature distribution when refrigerant flows through the channel 18 from a negative side toward a positive side in an X-axis direction. The temperature represented by the dashed line in the graph of FIG. 2 is a temperature distribution among the LED chips 11 when refrigerant flows through the channel 18 from the positive side toward the negative side in the X-axis direction. In both temperature distributions, the temperature of the LED chips 11 is 50° C. near a refrigerant inlet of the channel 18, cooling power gradually decreases by absorbing heat from the LED chips 11 as refrigerant flows through the channel 18, and the temperature of the LED chips 11 is 100° C. near an outlet of the channel 18. It is assumed that the channel 18 has an inlet and an outlet linearly coupled to each other and almost no temperature distribution occurs in the Y-axis direction.

Next, the relationship between the temperature and life of an LED chip 11 will be described. Here, the temperature of the light-emitting surface of the LED chip 11 is referred to as junction temperature. The life of the LED chip 11 can be estimated by using Arrhenius equation as expressed by the expression (1). L denotes life, A denotes constant, E denotes activation energy, K denotes Boltzmann constant, and T denotes junction temperature.

$$L=A\times\exp(E/KT) \quad (1)$$

Figure 3:
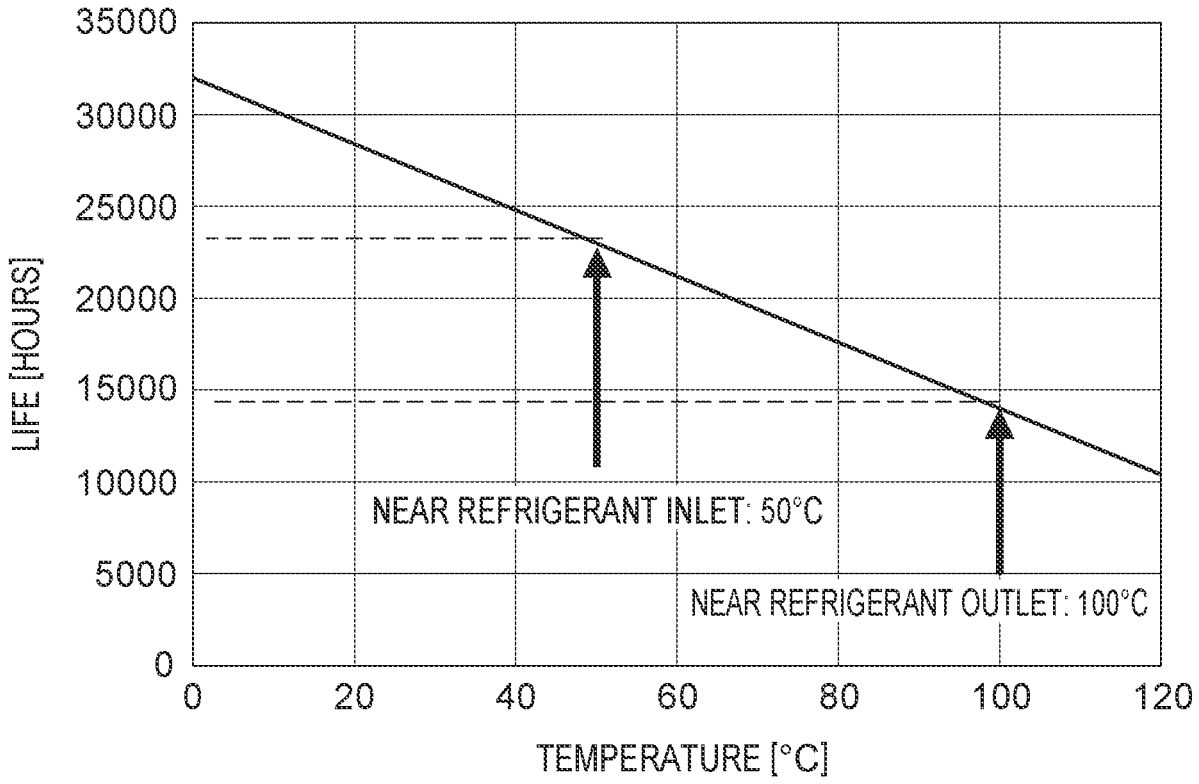
FIG. 3 is a graph showing the relationship between temperature and life of an LED chip.

From the expression (1), when the activation energy (that is, current) is the same, only the junction temperature influences the length of the life of an LED chip, and the life of the LED chip 11 extends as the junction temperature decreases. FIG. 3 is a graph showing an example of the relationship between the temperature and life of each LED chip 11. The horizontal axis of the graph shown in FIG. 3 represents the temperature of the LED chip 11, and the vertical axis represents life at the time when the LED chip 11 continues to emit light at that temperature. In FIG. 3, the life is 23000 hours when the LED chip 11 continues to emit light at 50° C.; whereas the life is 14000 hours when the LED chip 11 continues to emit light at 100° C. When applied to the example of FIG. 2, the life of the LED chips 11 disposed near the refrigerant outlet of the channel 18 is significantly shorter than the life of the LED chips 11 disposed near the refrigerant inlet of the channel 18.

When part of the LED chips 11 reach the end of life and, as a result, a target illuminance of the light source device 10 cannot be achieved, the whole circuit board 12 is generally replaced with a new one to replace the LED chips with new ones. When the LED chips 11 are replaced together with the circuit board 12 in this way, a replacement timing depends on the one with the shortest life among the plurality of LED chips 11.

When refrigerant flows through the channel 18 only in one direction, most of the LED chips are not used to the end of life.

When the flow direction of refrigerant is reversed to the opposite direction, the inlet-side temperature distribution and outlet-side temperature distribution of the channel 18 are inverted, the life of the LED chips 11 disposed near the refrigerant outlet of the channel 18 in the above description extends. As for the number of times and a timing to invert the channel, the life extends most when the lighting time of the LED chips 11 while refrigerant is flowing in the original direction is equal to the lighting time of the LED chips 11 while refrigerant is flowing in a direction opposite to the original direction.

The length of life at that time is about 18500 hours that is the length of life at 75° C. that is an average value of 50° C. and 100° C. In the case where the flow direction of refrigerant is inverted only once, the replacement timing of an LED light source module is delayed to about the latest 18500 hours when the flow direction of refrigerant is inverted at the time when the lighting time reaches 9250 hours that is half the length of life at 75° C. In other words, when the channel is inverted at least once within the length of life of the LED chips 11, the life that is about 14000 hours can be extended up to about 18500 hours.

The number of times the flow direction of refrigerant is inverted may be once as described above or may be multiple times. Alternatively, the flow direction of refrigerant may be inverted at intervals of a certain time period (for example, at intervals of 100 hours). When, for example, the light source device 10 is used for an exposure apparatus, work for inverting the flow direction of refrigerant is performed while the exposure apparatus is down due to maintenance or the like of the exposure apparatus. Thus, the plurality of LED chips 11 can be used without waste while the operating rate of the apparatus is not decreased. When the flow direction of refrigerant is changed, refrigerant after a heat exchange flows back before being cooled by the refrigerator 16. To avoid this situation, work for inverting the flow direction of refrigerant can be performed when the LED chips 11 are turned off.

Example 1

Figure 4:
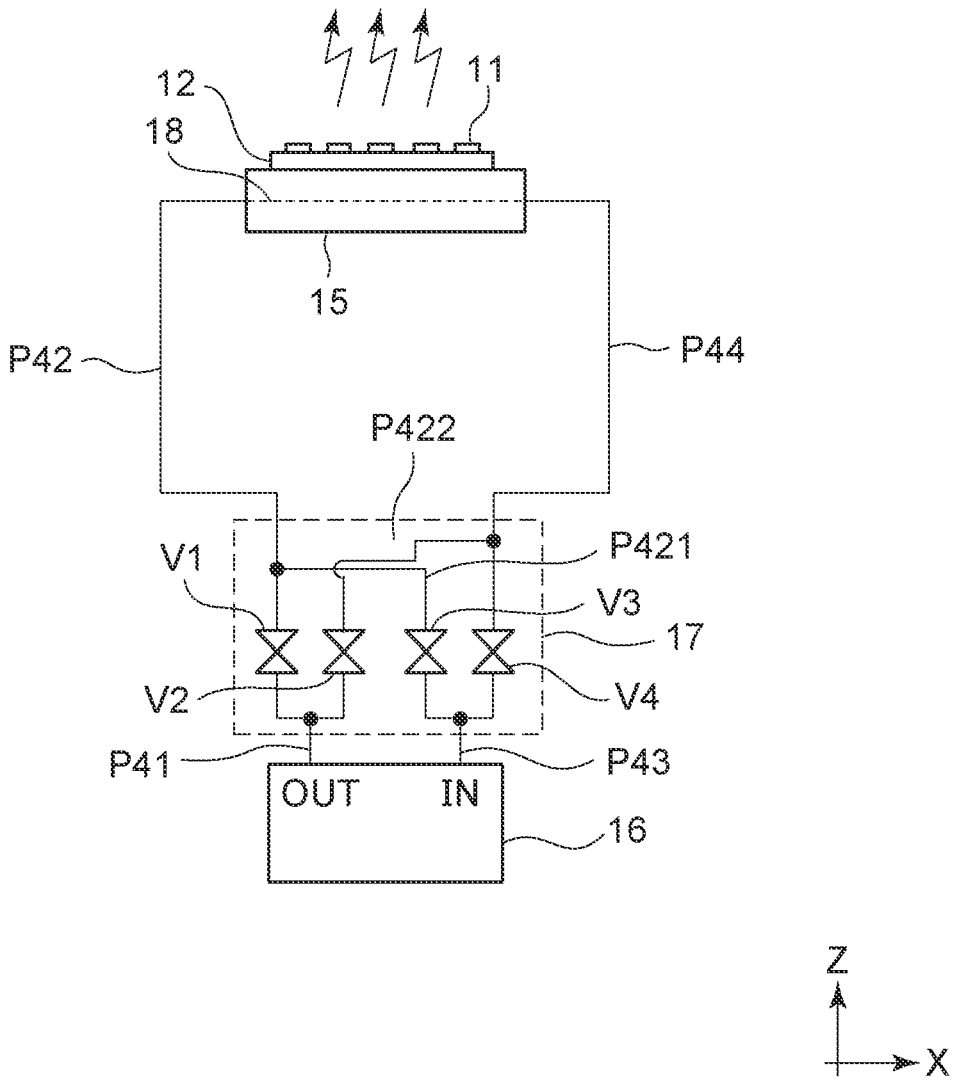
FIG. 4 is a schematic diagram of a light source device in a first example of a first embodiment.

In Example 1, an example in which the switching mechanism 17 (switching unit) is made up of four valves and the flow direction of refrigerant through the channel 18 can be switched from a first direction to a second direction that is a direction opposite to the first direction will be described. FIG. 4 is a diagram showing the light source device 10 in Example 1. A pipe P41 is connected to the refrigerant outlet (indicated by OUT in the drawing) of the refrigerator 16. The pipe P41 is bifurcated in the middle and connected to a valve V1 (first valve) and a valve V2 (second valve) in the switching mechanism 17. A pipe P43 is connected to the refrigerant inlet (indicated by IN in the drawing) of the refrigerator 16, bifurcated, and connected to a valve V3 (third valve) and a valve V4 (fourth valve). FIG. 4 shows that the pipes are bifurcated inside the switching mechanism 17; however, the pipes may be bifurcated outside the switching mechanism 17.

A pipe P42 and a pipe P421 are respectively connected to the valve V1 and the valve V3, and the pipe P421 merges with the pipe P42. A pipe P422 and a pipe P44 are respectively connected to the valve V2 and the valve V4, and the pipe P422 merges with the pipe P44. The pipe P42 and the pipe P44 are respectively connected to different ends of the channel 18 inside the heatsink 15. The control section 14 may be connected to the switching mechanism 17 to control the operations of the valves.

The operations of the valve V1 to valve V4 in this example will be described. The valve V1 and the valve V4 constantly operated in the same open/closed state, and the valve V2 and the valve V3 are constantly operated in the same open/closed state. In a state where the valve V1 and the valve V4 are open, the valve V2 and the valve V3 are operated to be closed. In a state where the valve V1 and the valve V4 are closed, the valve V2 and the valve V3 are operated to be open. By the operation as described above, the flow direction of refrigerant through the channel 18 can be inverted.

The valves may be operated manually or may be operated by the control section 14 such that four valves are driven in synchronization with one another as electric valves. As for the timing to perform work for inverting the flow direction of refrigerant, the timing may be controlled by the control section 14 so as to switch the flow direction after a lapse of a predetermined time or the timing may be determined artificially.

Example 2

Figure 5:
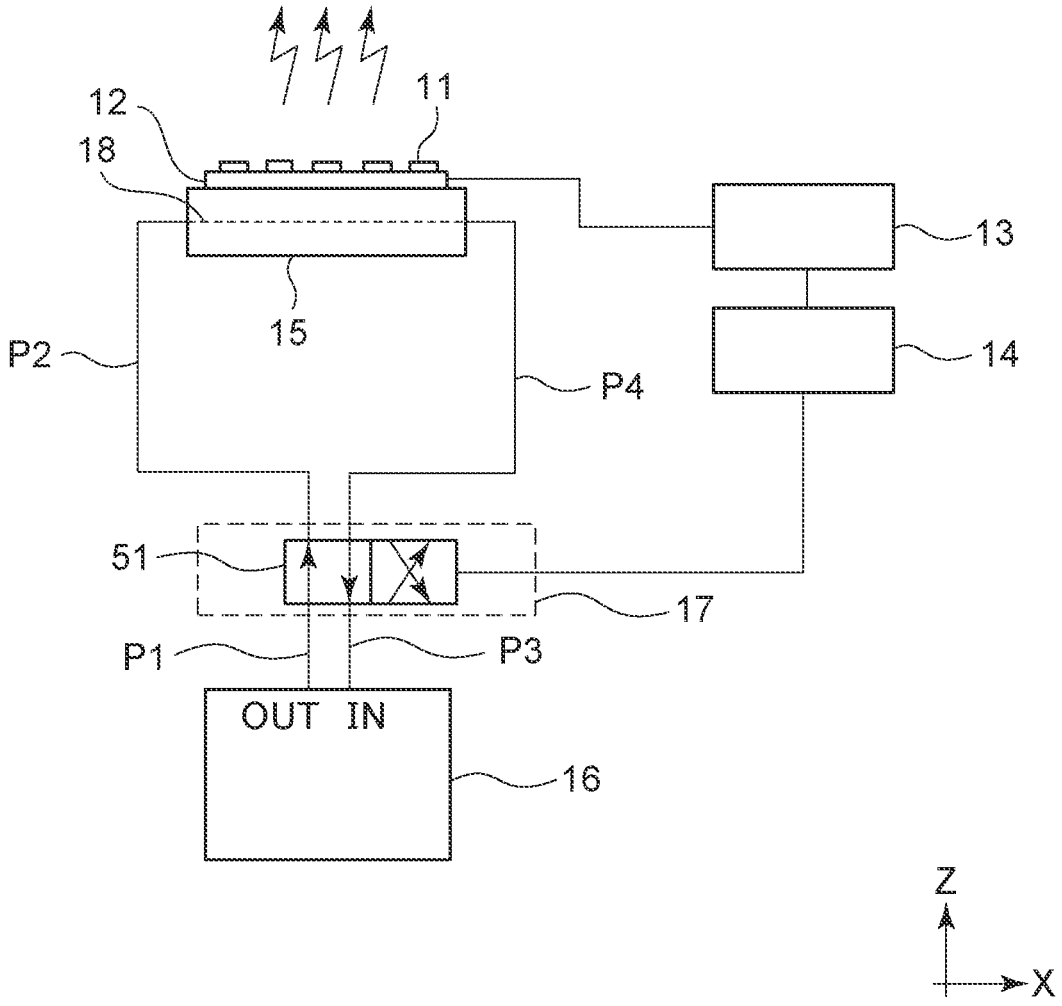
FIG. 5 is a schematic diagram of a light source device in a second example of the first embodiment.

In Example 2, an example in which the switching mechanism 17 (switching unit) includes an electromagnetic valve 51 capable of switching the flow direction of refrigerant through the channel 18 from a first direction to a second direction that is a direction opposite to the first direction will be described. FIG. 5 is a diagram showing the light source device 10 in Example 2. The electromagnetic valve 51 has four ports for connecting the pipes P1, P3 and the pipes P2, P4. The electromagnetic valve 51 is capable of taking two positions, that is, a position in which the pipes P1 and P2 are connected and the pipes P3 and P4 are connected and a position in which the pipes P1 and P4 are connected and the pipes P3 and P2 are connected. The electromagnetic valve 51 is connected to the control section 14, and commands for driving the electromagnetic valve 51 of the switching mechanism 17 and the drive of the electromagnetic valve 51 are controlled by the control section 14.

When the electromagnetic valve 51 takes one of the positions, refrigerant discharged from the refrigerator 16 is guided to the channel 18 through the pipe P1 and the pipe P2 and returned to the refrigerator 16 through the pipe P4 and the pipe P3. When the electromagnetic valve 51 takes the other one of the positions, refrigerant discharged from the refrigerator 16 is guided to the channel 18 through the pipe P1 and the pipe P4 and returned to the refrigerator 16 through the pipe P2 and the pipe P3. By changing the position of the electromagnetic valve 51, the flow direction of refrigerant through the channel 18 can be inverted.

The drive of the electromagnetic valve has been described on the assumption that the electromagnetic valve is driven by the control section 14 as an electrically-driven electromagnetic valve. Alternatively, the electromagnetic valve may be driven manually. As for the timing to perform work for inverting the flow direction of refrigerant, the timing may be controlled by the control section 14 so as to switch the flow direction after a lapse of a predetermined time or the timing may be determined artificially.

Example 3

Figure 6B:
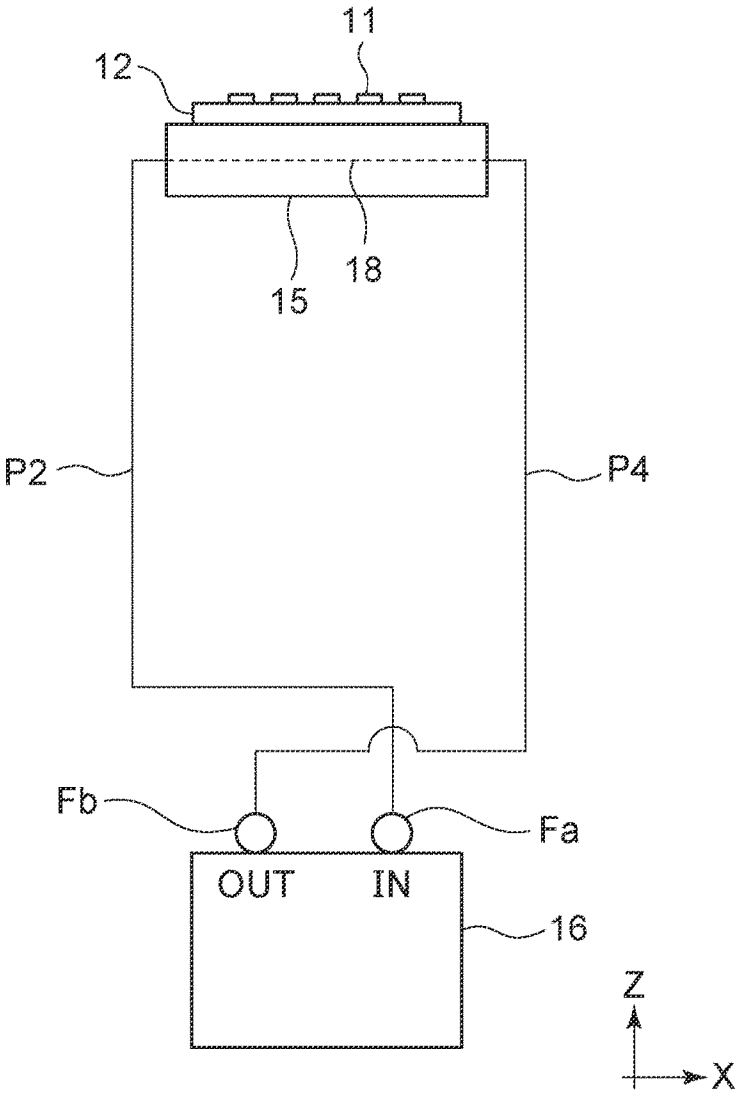
FIG. 6A and FIG. 6B are schematic diagrams of a light source device in a third example of the first embodiment.
Figure 6A:
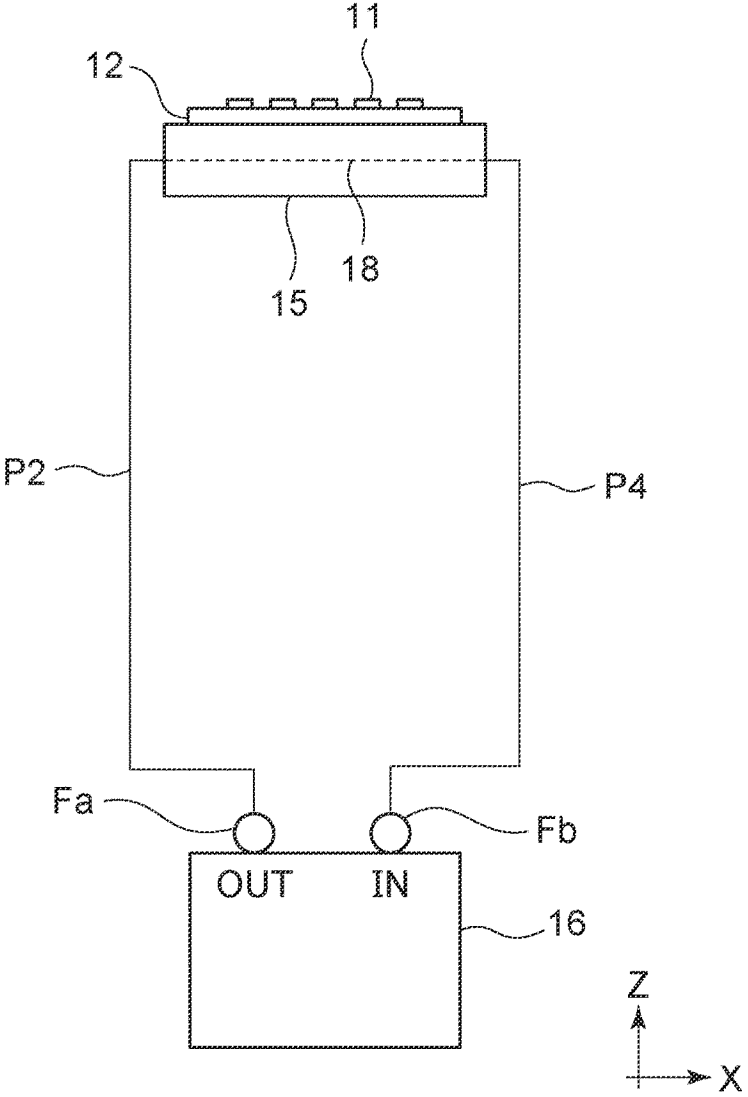

In Example 3, an example in which no switching mechanism 17 is provided as a switching unit will be described. In Example 3, a switching unit capable of switching the flow direction of refrigerant from a first direction to a second direction that is a direction opposite to the first direction by artificially switching destinations to which pipes are connected is provided. FIG. 6A and FIG. 6B are diagrams showing the light source device 10 in Example 3. FIG. 6A shows the light source device 10 before switching. FIG. 6B shows the light source device 10 after switching.

In FIG. 6A, a joint Fa is connected to the refrigerant outlet (indicated by OUT in the drawing) through which refrigerant is discharged from the refrigerator 16. One end of the pipe P2 is connected to the joint Fa, and the other end of the pipe P2 is connected to one end of the channel 18. The pipe P4 is connected to the other end of the channel 18, and a joint Fb at the distal end portion of the pipe P4 is connected to the inlet (indicated by IN in the drawing) of the refrigerator 16. In other words, refrigerant flowing out from the refrigerator 16 passes through the pipe P2, the channel, and the pipe P4 and returns to the refrigerator 16.

In FIG. 6B, destinations to which the pipe P2 and the pipe P4 are connected are changed from the state of FIG. 6A. One end of the pipe P4 is connected to the joint Fb, and the other end of the pipe P4 is connected to the one end of the channel 18. The pipe P2 is connected to the other end of the channel 18, and the joint Fa at the distal end portion of the pipe P2 is connected to the inlet (indicated by IN in the drawing) of the refrigerator 16. In other words, refrigerant flowing out from the refrigerator 16 passes through the pipe P4, the channel, and the pipe P2 and returns to the refrigerator 16.

In this example, by manually changing the destinations to which the pipes are connected, the flow direction of refrigerant can be changed. The joint Fa and the joint Fb can be the ones with the same shape and are compatible with both IN and OUT of the refrigerator 16 when connection destinations are changed. Although not shown in the drawing, a stop valve may be installed such that refrigerant does not leak during work for changing connection. Furthermore, when a special joint capable of achieving connection by just inserting the joint is used, convenience at the time of changing improves.

Example 4

Figure 7:
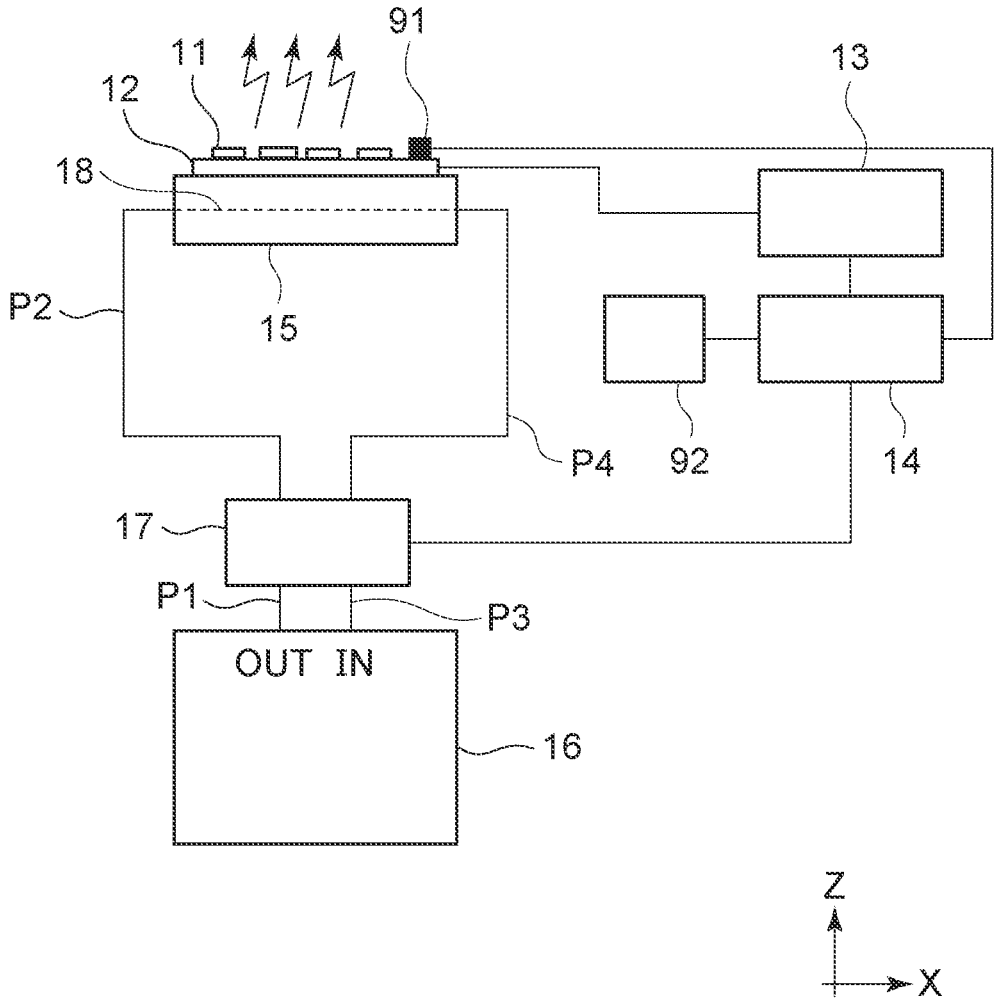
FIG. 7 is a schematic diagram of a light source device in a fourth example of the first embodiment.

In Example 4, an example in which the timing at which the switching mechanism 17 (switching unit) switches the flow direction of refrigerant through the channel 18 from a first direction to a second direction that is a direction opposite to the first direction is optimized will be described. In Example 4, when the temperature of the LED chips 11 is constantly measured (or the temperature of refrigerant is measured and the temperature of the LED chips 11 is predicted) and the lighting time is recorded, the timing to switch the flow direction of refrigerant through the channel 18 is determined. FIG. 7 is a diagram showing the light source device 10 in Example 4. The LED light source module includes a temperature sensor 91 that measures the temperature of the LED chips 11. The temperature sensor 91 may be provided on the heatsink 15. Alternatively, the control section 14 may be configured to be capable of predicting the temperature of the LED chips 11 by measuring the temperature of refrigerant. A storage section 92 is connected to the control section 14. The storage section 92 records information on the lighting time of the LED chips 11, temperature during lighting, and the like.

The control section 14 calculates a determination value by using a predetermined calculation expression in accordance with the lighting time of each LED chip 11 and the temperature during lighting. A determination value calculated by using a predetermined calculation expression is a determination value obtained by accumulating values of lighting time and temperature of the LED chip 11. When the determination value obtained by the control section 14 exceeds a preset threshold, the control section 14 issues a command for causing the switching mechanism 17 to switch and invert the flow direction of refrigerant through the channel 18.

Alternatively, by changing a calculation expression for calculating a determination value or a threshold, the inversion timing can be adjusted. When the control section 14 controls the timing of inversion work as in the case of the present example, the flow direction of refrigerant can be switched at a timing obtained in consideration of actual operation.

Figure 8:
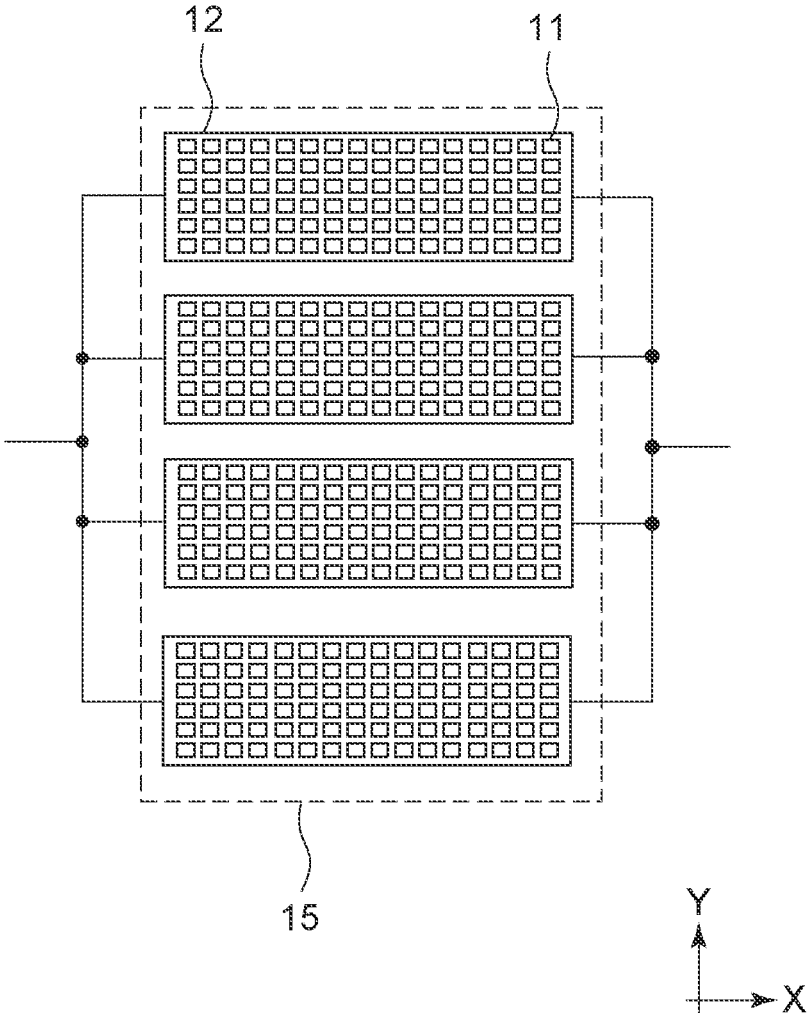
FIG. 8 is a diagram showing a light source device in which a plurality of LED light source modules is connected in parallel.

In Examples 1 to 4, an example in which a single LED light source module is disposed in correspondence with a single refrigerator 16 is described. Alternatively, a plurality of LED light source modules may be connected in parallel to a single refrigerator 16. FIG. 8 is a diagram showing the light source device 10 in which a plurality of LED light source modules is connected in parallel. In this case, the LED light source modules can have the same characteristics. Alternatively, the switching mechanism 17 (switching unit) may be provided in correspondence with each of a plurality of LED light source modules, and the flow direction of refrigerant through the channel 18 may be changed according to the lighting time of an associated one of the LED light source modules.

Modification Example

Figure 9:
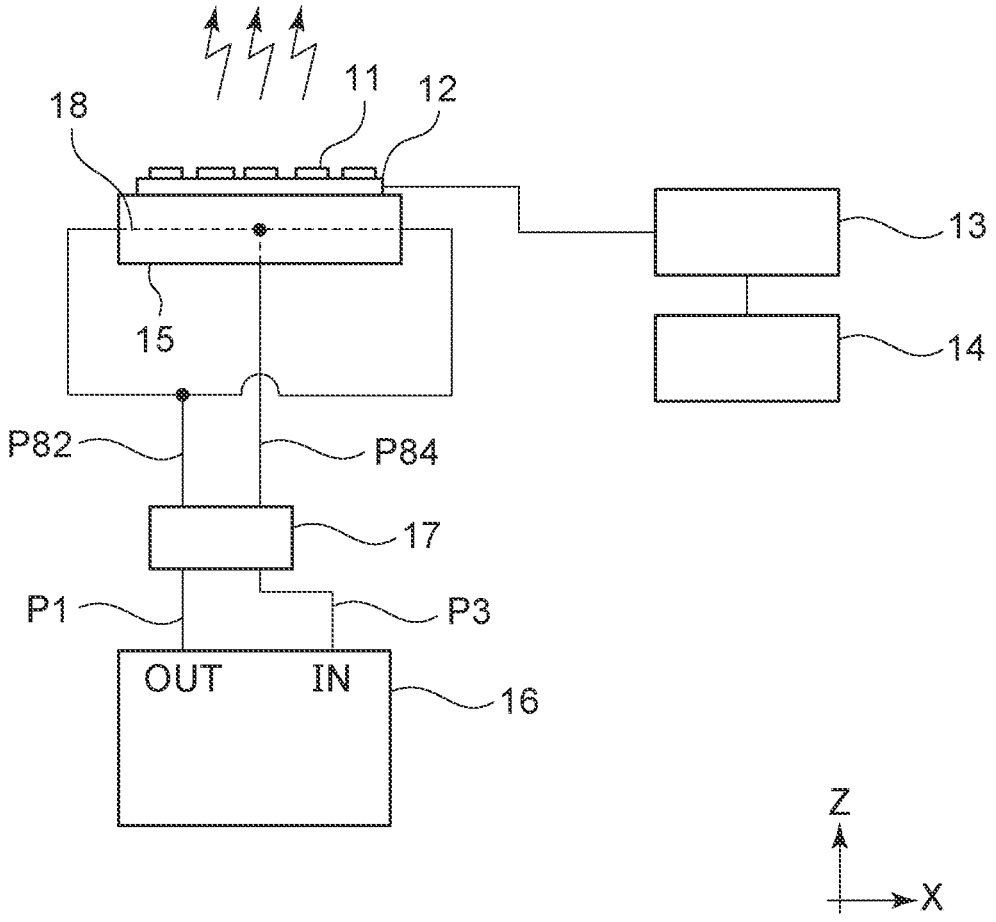
FIG. 9 is a schematic diagram of a light source device in a modification example of the first embodiment.

In Examples 1 to 4, an example in which a channel through which refrigerant flows from one end to the other end is formed is described; however, the configuration is not limited thereto. FIG. 9 is a diagram showing the light source device 10 having a channel different from the channel 18 described in Examples 1 to 4. In FIG. 9, a refrigerant inlet/outlet is also provided at the center of the heatsink 15. A pipe P82 connects the switching mechanism 17 and the heatsink 15, bifurcated in the middle, and connected to both ends of the channel 18. The center of the channel 18 and the switching mechanism are connected by a pipe P84. The flow direction of refrigerant is switched between when refrigerant flows in from both ends of the channel 18 and is discharged from the center of the channel 18 and when refrigerant flows in the opposite direction.

Generally, when a cooling channel is formed in a linear shape, the flow velocity of refrigerant is increased, with the result that cooling efficiency increases. A method of increasing temperature uniformity by disposing a meandering narrow channel in the heatsink 15 is also conceivable; however, the flow velocity of refrigerant decreases, with the result that cooling efficiency decreases as a whole. For this reason, the channel 18 inside the heatsink 15 can be in a non-meandering shape as much as possible.

Thus, in the present embodiment, the flow direction of refrigerant inside the heatsink 15 in the light source device 10 can be switched to the opposite direction. Thus, even when there is a temperature nonuniformity among the plurality of LED chips 11, the life of the plurality of LED chips 11 can be averaged. Therefore, the timing to replace the LED chips 11 together with the circuit board 12 can be delayed, so the replacement timing of an LED light source module can be delayed.

Embodiment of Illumination Apparatus

Figure 10:
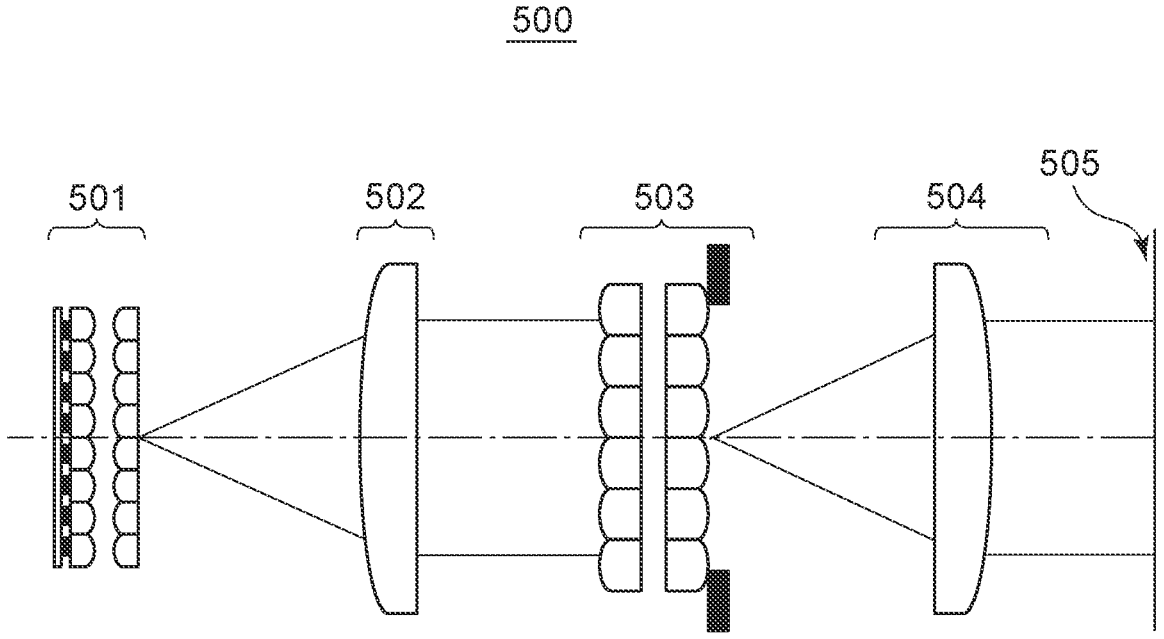
FIG. 10 is a schematic diagram of an illumination optical system.

Next, an example of an illumination optical system will be described with reference to FIG. 10. FIG. 10 is a schematic sectional view of an illumination optical system 500. The illumination optical system 500 includes a light source unit 501, a condenser lens 502, an integrator optical system 503, and a condenser lens 504. A light flux emitted from the light source unit 501 passes through the condenser lens 502 and reaches the integrator optical system 503.

The condenser lens 502 is designed such that an exit plane position of the light source unit 501 and an incident plane position of the integrator optical system 503 optically become a Fourier conjugate plane. Such an illumination system is called Kohler illumination. The condenser lens 502 is drawn as a single plano-convex lens in FIG. 10. Actually, the condenser lens 502 is often made up of a lens unit including a plurality of lenses. By using the integrator optical system 503, a plurality of secondary light source images conjugate with the exit plane of the light source unit 501 is formed at the exit plane position of the integrator optical system 503. Light exited from the exit plane of the integrator optical system 503 reaches an illumination plane 505 via the condenser lens 504.

Figure 11:
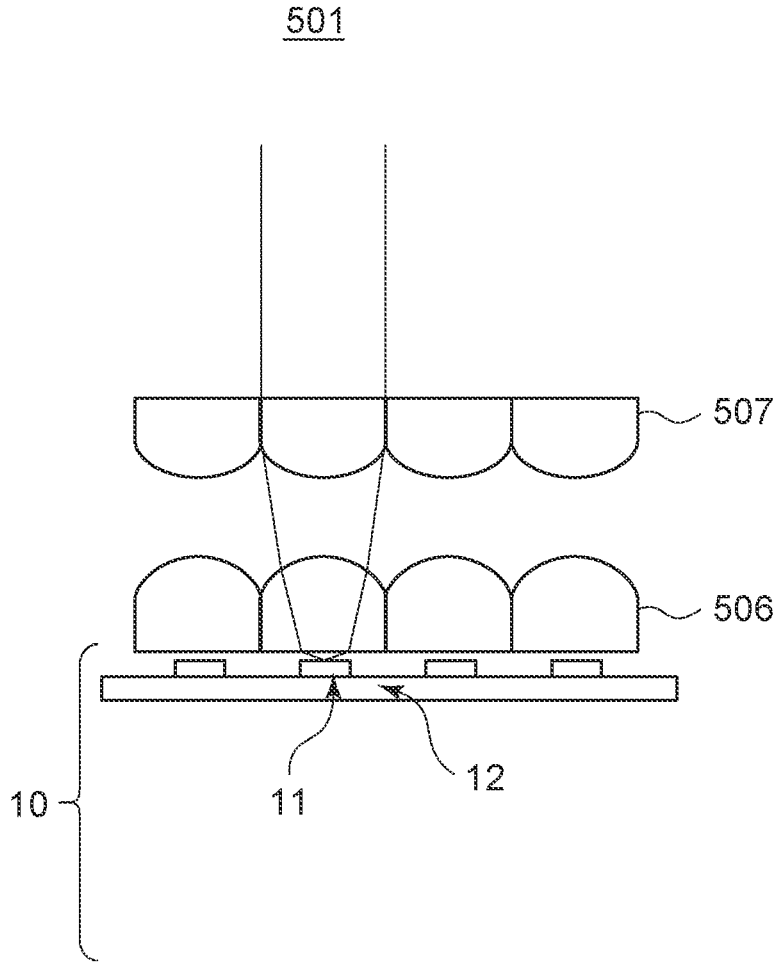
FIG. 11 is a schematic diagram of a light source unit.

The light source unit 501 will be described with reference to FIG. 11. FIG. 11 is a schematic diagram of the light source unit 501. The light source unit 501 includes the light source device 10, a collective lens 506, and a collective lens 507. FIG. 11 shows the LED chips 11 and the circuit board 12 as part of the light source device 10. Each of the collective lenses 506, 507 is a lens array having lenses provided in correspondence with the LED chips 11 of the light source device 10. The lenses of the collective lens 506 are respectively provided above the LED chips 11. Each lens may be a plano-convex lens as shown in FIG. 11 or may have a shape with another power. A lens array having lenses continuously formed by etching, cutting, or the like or a lens array formed by joining individual lenses may be used as a lens array. Light exited from the LED chip 11 has a divergence of about 50° to about 70° in half angle and is converted to about less than or equal to 30° by the collective lenses 506, 507. The collective lens 506 is spaced apart at a predetermined interval from the LED chips and may be integrally fixed together with the circuit board 12.

The description is back to FIG. 10. The integrator optical system 503 has a function of uniforming a light intensity distribution. An optical integrator lens or a rod lens is used for the integrator optical system 503, and the illuminance uniformity coefficient of the illumination plane 505 is improved.

The condenser lens 504 is designed such that the exit plane of the integrator optical system 503 and the illumination plane 505 optically become a Fourier conjugate plane, and the exit plane of the integrator optical system 503 or its condenser plane becomes a pupil plane of the illumination optical system. As a result, on the illumination plane 505, an almost uniform light intensity distribution can be created.

The illumination optical system 500 is applicable to various illumination apparatuses and may also be used for an apparatus that illuminates a photocurable resin, an apparatus that performs inspection by illuminating an object to be inspected, a lithography apparatus, or the like. The illumination optical system 500 is applicable to, for example, an exposure apparatus that exposes a substrate to light in a mask pattern, a maskless exposure apparatus, an imprint apparatus that forms a pattern on a substrate with a die, or a flat layer forming apparatus.

Embodiment of Exposure Apparatus

Figure 12:
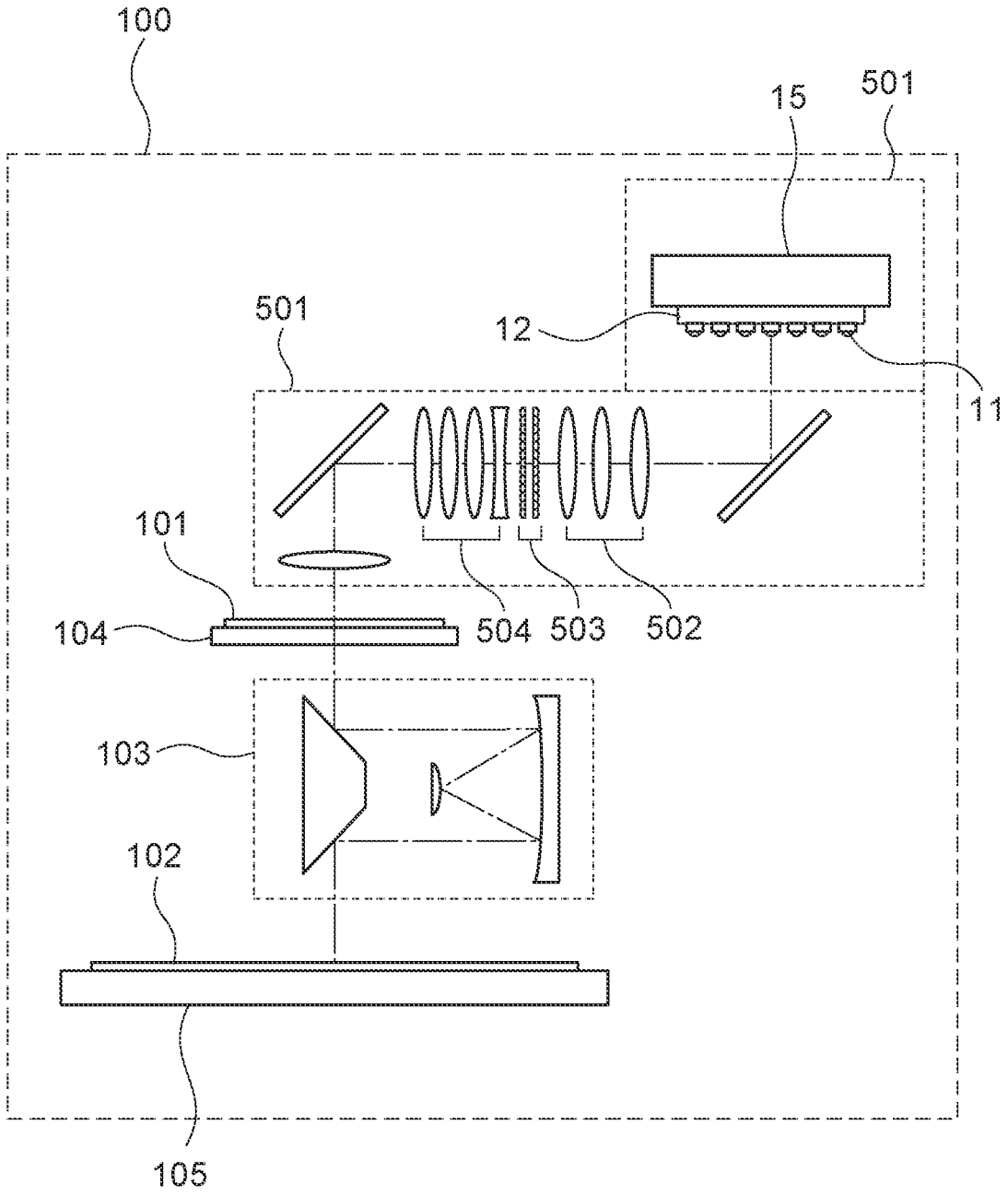
FIG. 12 is a schematic diagram of an exposure apparatus.

In the present embodiment, a case where the light source device 10 and the illumination optical system 500 are applied to an exposure apparatus will be described. FIG. 12 is a schematic diagram showing the configuration of an exposure apparatus 100. The exposure apparatus 100 is a lithography apparatus that is adopted to a lithography process that is a manufacturing process for a semiconductor device or a liquid crystal display element, and that forms a pattern on a substrate. The exposure apparatus 100 exposes a substrate to light via a mask to transfer a mask pattern to the substrate. The exposure apparatus 100 is a step-and-scan exposure apparatus, that is, a so-called scanning exposure apparatus, in the present embodiment and may adopt a step-and-repeat system or another exposure system.

The exposure apparatus 100 includes the illumination optical system 500 that illuminates a mask 101, and a projection optical system 103 that projects the pattern of the mask 101 onto a substrate 102. The projection optical system 103 may be a projection lens made up of a lens or a reflective projection system using a mirror.

The illumination optical system 500 illuminates the mask 101 with light from the light source device 10. A pattern corresponding to a pattern to be formed on the substrate 102 is formed in the mask 101. The mask 101 is held on a mask stage 104, and the substrate 102 is held on a substrate stage 105.

The mask 101 and the substrate 102 are disposed at an optically substantially conjugate position via the projection optical system 103. The projection optical system 103 is an optical system that projects a physical object to an image plane. A reflective optical system, a refractive optical system, or a catadioptric system may be applied to the projection optical system 103. In the present embodiment, the projection optical system 103 has a predetermined projection magnification and projects a pattern formed in the mask 101 onto the substrate 102. Then, the mask stage 104 and the substrate stage 105 are scanned at a velocity ratio according to the projection magnification of the projection optical system 103 in a direction parallel to the physical object plane of the projection optical system 103. Thus, the pattern formed in the mask 101 can be transferred to the substrate 102.

Embodiment of Irradiation Apparatus

Figure 13:
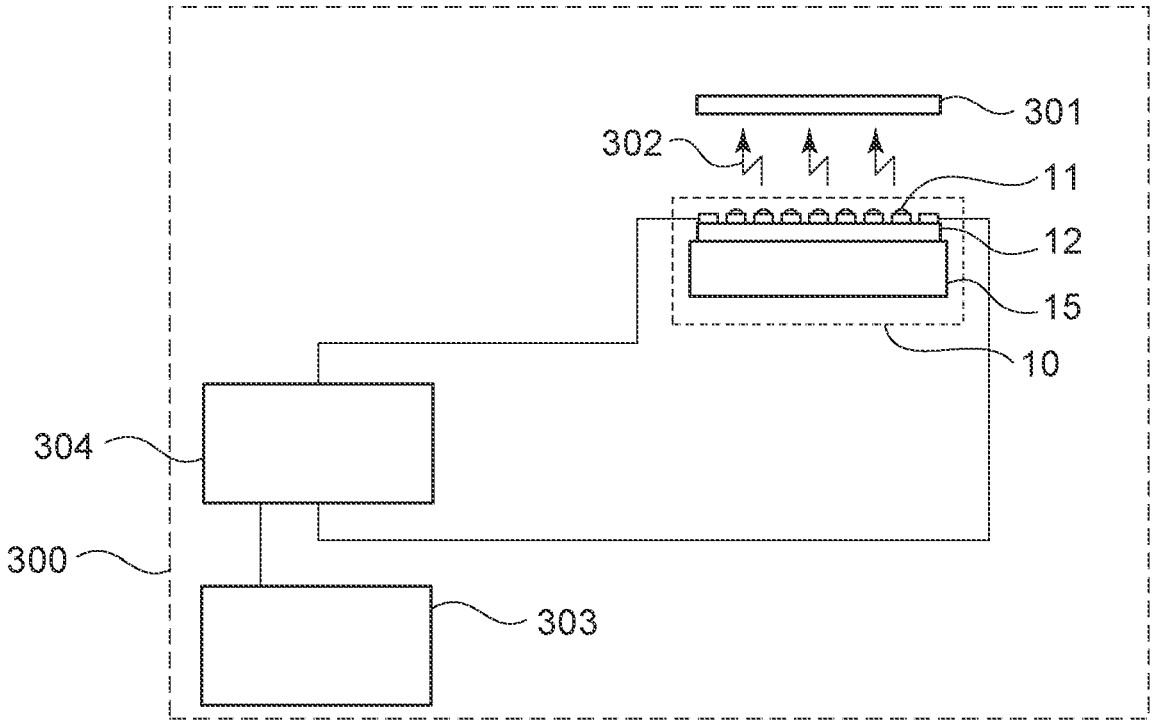
FIG. 13 is a schematic diagram of an irradiation apparatus.

In the present embodiment, a case where the light source device 10 and the illumination optical system 500 are applied to an irradiation apparatus 300 will be described. FIG. 13 is a schematic diagram showing the configuration of the irradiation apparatus 300. The irradiation apparatus 300 functions as an ultraviolet ray irradiation apparatus that irradiates irradiation light 302 in an ultraviolet ray wavelength range to an object to be irradiated 301. The irradiation apparatus 300 includes the light source device 10, an irradiation control apparatus 303, and a control section 304.

The object to be irradiated 301 is not limited as long as the object receives ultraviolet radiation. The object to be irradiated 301 may be a solid, a liquid, a gas, or a combination of any two or more of them. The irradiation light 302 is ultraviolet rays having wavelength characteristics that apply some action on the object to be irradiated 301. A sterilization treatment, a surface treatment, or the like is conceivable as the action of the irradiation light 302.

The irradiation control apparatus 303 is connected to the control section 304 that controls the light source device 10, and communicates with the control section 304. The control section 304 is controlled by outputting an on/off signal of current output, a command value of output current, and the like are from the irradiation control apparatus 303 to the control section 304. When the control section 304 detects a failure of an LED chip, a failure detection signal is output from the control section 304 to the irradiation control apparatus 303.

Embodiment of Process for Product

A manufacturing method for a product according to the embodiment of the disclosure is suitable for, for example, manufacturing an FPD. The manufacturing method for a product according to the present embodiment includes a step of forming a latent image pattern with the exposure apparatus on a photosensitive agent applied on a substrate (step of exposing a substrate) and a step of developing the substrate on which the latent image pattern is formed in the above step. The manufacturing method includes other known steps (oxidation, film formation, vapor deposition, doping, planarization, etching, resist removing, dicing, bonding, packaging, and the like). The manufacturing method for a product according to the present embodiment is beneficial in at least one of performance, quality, productivity, and production cost of a product as compared to an existing method.

The embodiments of the disclosure are described above; however, the disclosure is, of course, not limited to these embodiments. Various modifications and changes are possible within the scope of the disclosure.

According to the embodiments of the disclosure, it is possible to provide a light source device beneficial to delay the replacement timing of an LED light source module.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-203466, filed Dec. 8, 2020, which is hereby incorporated by reference herein in its entirety.

What is claimed is:

1. A device comprising:

a circuit board;

a plurality of light emitting elements (LEDs) disposed on the circuit board;

a heatsink configured to cool the plurality of LEDs; and a switching unit configured to switch a flow direction of refrigerant through a channel in the heatsink between a first direction and a second direction.

2. The device according to claim 1, further comprising a refrigerator configured to cool refrigerant discharged from the channel, wherein the refrigerant circulates through the channel and the refrigerator.

3. The device according to claim 1, wherein the plurality of LEDs is arranged on the circuit board in a two-dimensional array.

4. The device according to claim 1, wherein the circuit board includes a chip array in which the plurality of LEDs is arranged in series, and an array direction of the plurality of LEDs in the chip array has a component horizontal to the first direction and the second direction.

5. The device according to claim 1, wherein the switching unit includes a first plurality of valves including a first valve and a second valve configured to control refrigerant flowing through a pipe connected to one end of the heatsink and a second plurality of valves including a third valve and a fourth valve configured to control refrigerant flowing through a pipe connected to an other end of the heatsink, and the flow direction is switched between the first direction and the second direction by controlling the first plurality of valves and the second plurality of valves including the third valve and the fourth valve.

6. The device according to claim 5, further comprising a refrigerator configured to cool refrigerant discharged from the channel, wherein the first valve is a valve connecting a pipe connected to a refrigerant outlet of the refrigerator to a pipe connected to a refrigerant inlet of the channel, the second valve is a valve connecting a pipe connected to the refrigerant outlet of the refrigerator to a pipe connected to a refrigerant outlet of the channel, the third valve is a valve connecting a pipe connected to a refrigerant inlet of the refrigerator to a pipe connected to the refrigerant inlet of the channel, the fourth valve is a valve connecting a pipe connected to the refrigerant inlet of the refrigerator to a pipe connected to the refrigerant outlet of the channel, and the flow direction is switched between the first direction and the second direction by switching from a state where the first valve and the fourth valve are open and the second valve and the third valve are closed to a state where the first valve and the fourth valve are closed and the second valve and the third valve are open.

7. The device according to claim 1, wherein the switching unit includes an electromagnetic valve configured to switch a combination of pipes respectively connected to a refrigerant inlet and a refrigerant outlet of the channel and pipes respectively connected to a refrigerant inlet and a refrigerant outlet of the refrigerator.

8. The device according to claim 1, further comprising a storage section configured to record a lighting time of each of the LEDs disposed on the circuit board, wherein a timing to switch the flow direction of refrigerant through the channel is determined in accordance with the lighting time.

9. The device according to claim 8, further comprising a sensor configured to record at least one of a temperature of each of the LEDs and a temperature of refrigerant flowing through the channel, and a timing to switch the flow direction is determined in accordance with the measured temperature and the lighting time.

10. The device according to claim 9, wherein a determination value obtained by accumulating a value of the measured temperature and a value of the lighting time is calculated, and, when the determination value exceeds a threshold, a timing to switch the flow direction is determined.

* * * * *